United States Patent [19]

Diallo

[11] 4,190,914

[45] Mar. 4, 1980

[54] SLEEP UNIT

[76] Inventor: Souleymane Diallo, 19965 Snowden, Detroit, Mich. 48235

[21] Appl. No.: 891,211

[22] Filed: Mar. 29, 1978

[51] Int. Cl.[2] ..... A47C 27/08

[52] U.S. Cl. ..... 5/247; 5/DIG. 2; 5/255; 5/476

[58] Field of Search ..... 5/247, 255, 345, 351, 5/354, DIG. 2; 267/109, 142

[56] References Cited

U.S. PATENT DOCUMENTS

| | | | |
|---|---|---|---|
| 2,239,062 | 4/1941 | Tallmadge | 5/255 |
| 2,985,895 | 5/1961 | Bloom | 5/DIG. 2 |
| 3,080,579 | 3/1963 | Gordon | 5/354 |
| 3,551,924 | 1/1973 | Frye, Sr. | 5/351 |

*Primary Examiner*—Casmir A. Nunberg

*Attorney, Agent, or Firm*—Whittemore, Hulbert & Belknap

[57] ABSTRACT

The sleep unit includes a base upon which is mounted a single set of springs. These springs are overlaid with cushion material. The springs are leaf-type springs having a curved configuration. The spring action is such that the resistance to deflection increases with increased load. Thus, the sleep unit has an initial softness followed by increased firmness depending upon the weight of the user. Means are provided to permit pre-compression of the springs to vary the initial firmness of the sleep unit.

11 Claims, 4 Drawing Figures

FIG. 2
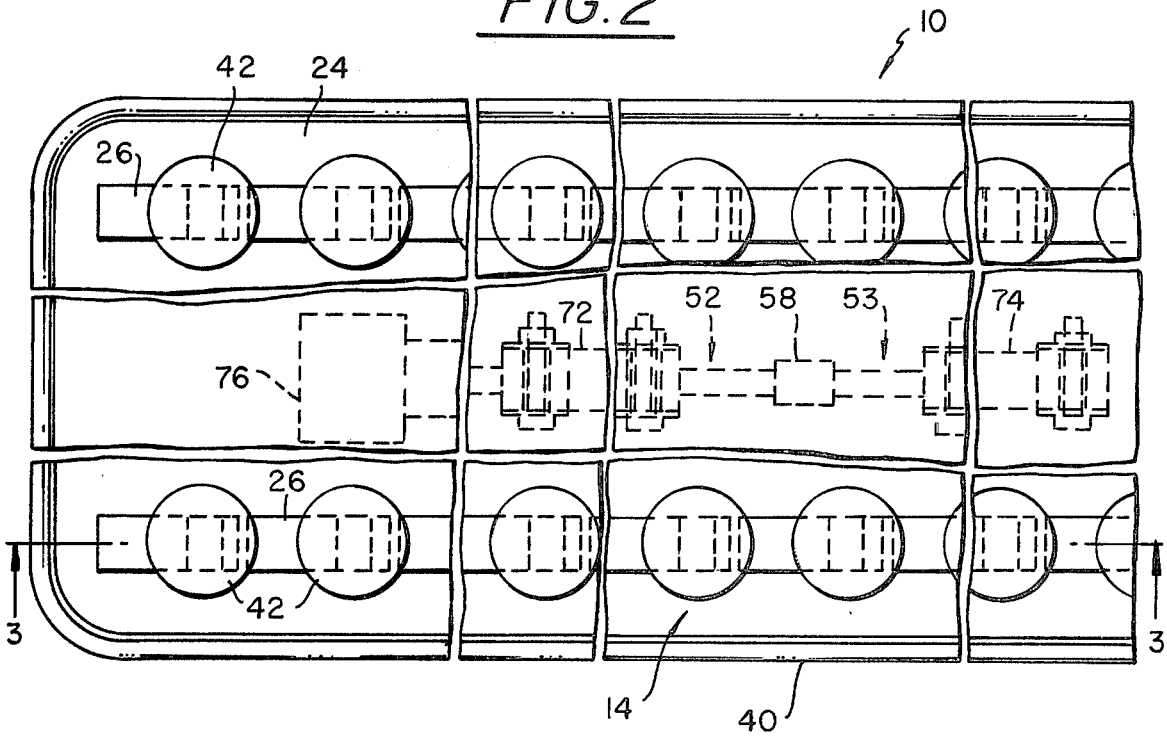
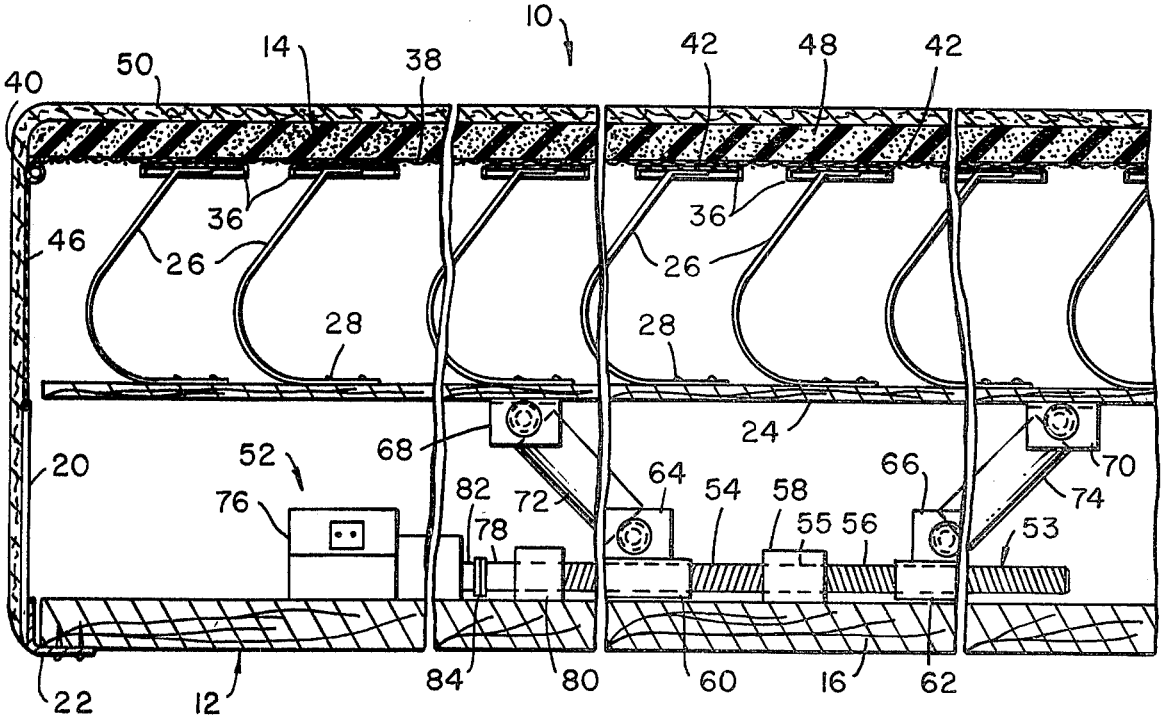
FIG. 3

SLEEP UNIT

BACKGROUND OF THE INVENTION

Historically, many different types of sleep units have been utilized. Such sleep units have varied from crude piles of straw laid on the ground to sophisticated structures involving complicated spring mechanisms.

In designing a sleep unit, it is desired to provide a degree of softness for the user while at the same time preventing undue deflection of the sleep unit which may result in the heavier torso portion of the body sinking deeper into the sleep unit than the legs and above shoulder regions of the body. It is also desired to prevent bottoming out of the sleep unit which may occur when the user is a large, heavy person.

One of the most common sleep units in use is a structure in which a box spring is supported in a bed frame. A mattress overlies the box spring. Usually the mattress is also provided with springs. Such a construction has proved generally satisfactory. However, the conventional structure is relatively expensive because two sets of springs are normally employed.

In accordance with the present invention, a single set of springs is utilized. The springs are of a curved leaf-type construction. In use, the spring resistance increases with deflection. This prevents undue deflection of the springs which are under the torso portion of a person's body. This spring construction also tends to prevent bottoming out.

SUMMARY OF THE INVENTION

The sleep unit comprises a support structure upon which are secured a plurality of spaced apart springs. Cushioning material overlies the springs. The springs comprise leaf springs having a lower portion secured to the support structure. An upwardly curved portion extends from the lower portion. An upwardly angled substantially straight portion extends from the curved portion. Means are provided for pre-compressing the springs to permit varying the initial firmness of the sleep unit.

IN THE DRAWINGS:

FIG. 2 is a top plan view of a portion of the sleep unit with portions removed for the purpose of clarity;

FIG. 3 is a longitudinal sectional view of the sleep unit taken substantially along line 3—3 of FIG. 2 looking in the direction of the arrows.

Figure 1:
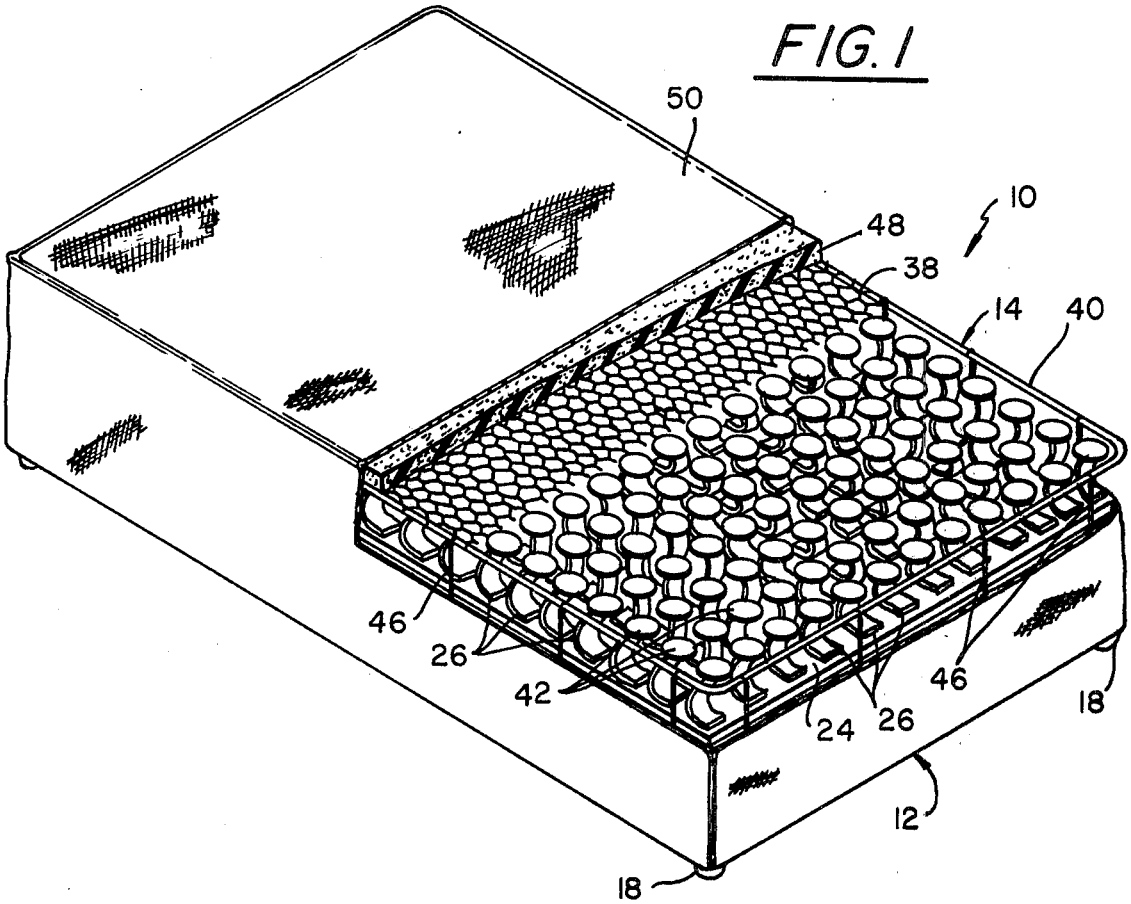
FIG. 1 is a view in perspective of the sleep unit with portions removed for the purpose of clarity.

Referring to FIGS. 1, 2 and 3, it will be noted that the sleep unit 10 comprises a base 12 which supports a spring and cushion assembly 14. The base 12 includes a lower wooden framework 16 with ground engaging foot elements 18 provided in each corner thereof. Upwardly extending tubular support elements 20 are secured in spaced apart relationship on the outer edges of the framework 16 by means of steel angles 22 which are directly secured to the framework 16.

The spring and cushion assembly 14 includes a plywood panel 24 of somewhat lesser size than the upper opening of the base 12. A plurality of spaced apart leaf-springs 26 are secured to the upper surface of the panel 24 as by staples 28 (FIG. 3). The springs 26 are the key elements of the sleep unit 10. These springs, when deflected, have an increasing spring resistance to further deflection. Thus, initially, the springs are relatively easy to deflect resulting in an initial soft feel to the user of the sleep unit. Upon greater deflection and particularly in consequence of various heavier parts of the body, the spring resistance increases thus resulting in a firmer feel of the unit and prevention of substantially greater indentation of one's portion of the body into the sleep unit than other portions of the body which would occur if the spring resistance stayed substantially the same.

Figure 4:
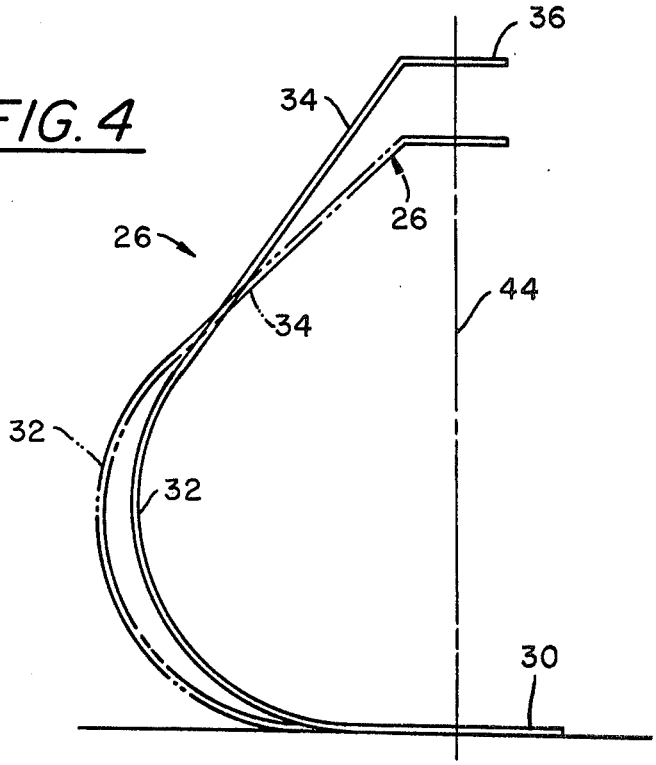
FIG. 4 is an elevational view of one of the springs used in the sleep unit illustrating this spring with and without pressure applied thereto.

The construction and action of the springs 26 may best be seen in FIG. 4. As will be noted, the springs 26 have a lower straight portion 30 which is secured to the panel 24. An upwardly curved portion 32 extends from straight portion 30. A second substantially straight portion 34 extends upwardly from curved portion 32 and terminates in a straight horizontal portion 36 which functions to engage the upper end of the spring with any applied force. In the present configuration, a wire mesh 38, mounted in a rectangular frame 40, is provided above the springs 26 in contact therewith. Each spring 26 is provided with a plastic or metallic cap 42 on the straight portion 36 to enlarge the contacting area with the wire mesh 38.

When a downward force is applied to the portion 36 of the spring as represented by the dotted line 44 of FIG. 4, the portion 36 follows the downward direction of the force as illustrated in dotted lines. This results in the configuration of the curved portion 32 changing as shown in dotted lines, with some bowing of the second straight portion 34. This changed configuration of the springs is what results in increasing the spring resistance as the spring is deflected. The more the spring is deflected downwardly, the more change which occurs in the curved portion 32 and straight portion 34 resulting in additional increase in spring resistance.

As may be seen in FIGS. 1 and 3, lateral movement of the wire mesh 38 and frame 40 is minimized by means of edge springs 46 which are connected at one end to the tubular members 20 and at the other end to the frame 40. Other types of spring connections may be used, as for example, a V-shaped wire spring may be secured between the base 12 and the frame 40. Lateral stability is also enhanced by facing the springs 26 in alternate rows in different directions as will be noted in FIG. 1. Only the end springs all face the same direction.

A layer of foam elastomer 48 is provided on the upper surface of the wire mesh 38. The entire sleep unit 10 is then covered with quilting 50. Alternate constructions may be provided wherein the base 12 and spring and cushion assembly 14 are more definitively separate units, with the quilting being provided separately for the base 12 and assembly 14.

As shown in FIGS. 2 and 3, means 52 are provided for varying the firmness of the sleep unit 10. These means include a rod 53 having a pair of screw thread portions 54, 56 each of which has opposite handed screw threads, one being right handed and the other left handed. Central unthreaded portion 55 is rotatively mounted in a bearing 58 which is secured to the framework 16. A moveable nut 60, 62 is received on each of the screw threaded portions 54, 56. Each of the nuts carries a U-shaped bracket 64, 66. Similiar U-shaped brackets 68, 70 are mounted on the undersurface of the panel 24. An arm 72, 74 is pivotally mounted between the adjacent upper and lower brackets 64, 68 and 66, 70 by means of nut and bolt structures. A geared electric motor 76 is supported on the framework 16. Unthreaded end 78 of rod 53 extends through a bearing 80 and is connected to the output shaft 82 of motor 76 by means of coupling 84.

The motor 76, which is a reversible motor, is capable of driving the screw structure in either the clockwise or counterclockwise direction. When the screw structure is rotated in one direction, it will cause the nuts 60, 62 to be threaded outwardly of the screw structure. This will result in the arms 72, 74 being moved to a more vertical position. The brackets 68, 70, which are offset outwardly from the brackets 64, 66 are in a fixed position. Thus, as the arms 72, 74 assume a more vertical orientation, upward pressure is applied to the brackets 68, 70 causing the panel 24 to rise thereby compressing the springs 26. This compression results in the sleep unit being initially firmer. Rotation of the screw structure in the opposite direction will result in lowering of the panel 24 thus extending the springs 26 and reducing the initial firmness of the sleep unit.

Instead of an electric motor 76, a hand crank structure may be employed. Further, instead of only one screw structure, two or more screw structures may be placed across the width of the panel 24 to result in a more uniform lifting action. The panel 24 may be strengthened in the area of the screw structure by use of a framework of metal bars.

Having thus described my invention, I claim:

1. A sleep unit comprising a support structure, a plurality of spaced apart springs secured on said support structure, cushioning material overlying said springs, said springs comprising leaf-springs having a lower portion secured to the support structure, an upwardly curved portion extending from said lower portion, and an upwardly angled straight portion extending from said curved portion.

2. A sleep unit as defined in claim 1, further characterized in that said lower portion is substantially straight.

3. A sleep unit as defined in claim 1, further characterized in the provision of a substantially horizontal portion being in contact with said cushioning material.

4. A sleep unit as defined in claim 1, further characterized in the provision of a flexible sheet of relatively high strength material forming part of said cushioning material and directly overlying said springs.

5. A sleep unit as defined in claim 4, further characterized in that said flexible sheet is wire mesh.

6. A sleep unit as defined in claim 1, further characterized in that said support structure includes means for pre-compressing said springs to result in a desired initial firmness of the sleep unit.

7. A sleep unit as defined in claim 6, further characterized in the provision of a panel beneath said springs, said springs being secured to said panel, connecting means between said cushioning material and said support structure, said means for pre-compressing the springs being mounted on the support structure beneath said pandl and including structure for raising and lowering said panel.

8. A sleep unit as defined in claim 1, further characterized in that said springs are arranged in rows, the springs of alternate rows having the curved portion of the springs facing in the direction of the extent of the rows and in the opposite direction.

9. A sleep unit comprising a support structure, a plurality of spaced apart springs secured on said support structure, cushioning material overlying said springs, said springs comprising leaf-springs having a lower portion secured to the support structure, an upwardly curved portion extending from said lower portion, and an upwardly angled substantially straight portion extending from said curved portion, wherein said support structure includes means for pre-compressing said springs to result in a desired initial firmness of the sleep unit comprising a panel beneath said springs, said springs being secured to said panel, connecting means between said cushioning material and said support structure, said means for pre-compressing the springs being mounted on the support structure beneath said panel and including structure for raising and lowering said panel, comprising at least one screw element having a pair of oppositely handed threaded portions thereon, a pair of nuts having oppositely handed internally threaded openings received on said threaded portions, a pair of arms, each arm being pivotally connected at one end to the underside of said panel and at the other end to one of said nuts whereby rotation of said screw will cause the nuts to move in opposite directions thereby changing the angular orientation of said arms to raise and lower said panel.

10. A sleep unit as defined in claim 9, further characterized in the provision of a reversible electric motor connected to said screw element for driving of said screw element.

11. A sleep unit comprising a support structure, a plurality of spaced apart free standing springs secured to said support structure, cushioning material overlying said springs, said springs comprising leaf-springs having a lower portion secured to the support structure, an upwardly curved portion extending from said lower portion, and an upwardly angled straight portion extending from said curved portion.

* * * * *